US010024047B2

(12) United States Patent
Zavitz

(10) Patent No.: US 10,024,047 B2
(45) Date of Patent: Jul. 17, 2018

(54) METHOD AND APPARATUS FOR CONSTRUCTING A CONCRETE STRUCTURE

(71) Applicant: Tindall Corporation, Spartanburg, SC (US)

(72) Inventor: Bryant A. Zavitz, Dunwoody, GA (US)

(73) Assignee: Tindall Corporation, Spartanburg, SC (US)

( * ) Notice: Subject to any disclaimer, the term of this patent is extended or adjusted under 35 U.S.C. 154(b) by 0 days.

(21) Appl. No.: 15/236,440

(22) Filed: Aug. 14, 2016

(65) Prior Publication Data

US 2017/0051495 A1 Feb. 23, 2017

Related U.S. Application Data

(60) Provisional application No. 62/205,874, filed on Aug. 17, 2015.

(51) Int. Cl.

| | |
|---|---|
| ***E04B 1/21*** | (2006.01) |
| ***E04C 3/34*** | (2006.01) |
| ***E04C 5/12*** | (2006.01) |

(52) U.S. Cl.

CPC ..... *E04B 1/215* (2013.01); *E04C 3/34* (2013.01); *E04C 5/12* (2013.01)

(58) Field of Classification Search

CPC ..... E04B 1/22; E04B 1/1903; E04B 1/215; E04B 1/30; E04C 3/34; E04C 5/12

See application file for complete search history.

(56) References Cited

U.S. PATENT DOCUMENTS

| | | | | | |
|---|---|---|---|---|---|
| 3,245,190 | A * | 4/1966 | Reiland | E04C 3/34 | 52/649.3 |
| 3,369,334 | A * | 2/1968 | Berg | E04B 1/06 | 52/223.13 |
| 3,621,626 | A * | 11/1971 | Adolfo | E04B 1/043 | 403/363 |
| 3,782,061 | A * | 1/1974 | Minutoli | E04B 1/06 | 52/125.5 |
| 3,965,627 | A * | 6/1976 | Fencl | E04H 1/005 | 52/125.5 |

(Continued)

FOREIGN PATENT DOCUMENTS

| | | | | |
|---|---|---|---|---|
| GB | 2503228 A * | 12/2013 | | E04B 1/215 |
| WO | WO 2017031136 A1 * | 2/2017 | | |

OTHER PUBLICATIONS

Written Opinion for PCT/US2016/047228 dated Nov. 15, 2016 (3 pages).*

(Continued)

*Primary Examiner* — Rodney Mintz
(74) *Attorney, Agent, or Firm* — Meunier Carlin & Curfman LLC

(57) ABSTRACT

The present invention broadly comprises a method and apparatus for constructing a concrete structure. In one embodiment, a structure includes a column section and a beam section. One of the column section and the beam section includes an assembly with a threaded rod, and the other of the column section and the beam section includes an assembly having an aperture configured to receive the threaded rod.

10 Claims, 11 Drawing Sheets

(56) References Cited

U.S. PATENT DOCUMENTS 4,024,688 A * 5/1977 Calini ..... E04C 5/165 403/310
4,099,360 A * 7/1978 Outram ..... E02D 5/523 52/126.7
4,694,621 A * 9/1987 Locke ..... E04B 1/22 403/147
5,123,220 A * 6/1992 Simenoff ..... E04B 1/22 52/236.8
5,152,118 A * 10/1992 Lancelot ..... E04C 5/165 52/848
5,261,198 A * 11/1993 McMillan ..... E04G 21/142 52/125.5
5,305,573 A * 4/1994 Baumann ..... E04C 5/165 403/305
5,308,184 A * 5/1994 Bernard ..... E04C 5/12 403/305
5,366,672 A * 11/1994 Albrigo ..... B28B 23/043 264/219
5,561,956 A 10/1996 Englekirk et al.
5,974,761 A * 11/1999 Mochizuki ..... E04C 5/165 403/267
6,065,263 A * 5/2000 Taguchi ..... E04B 5/023 403/305
6,192,647 B1 * 2/2001 Dahl ..... E04C 3/34 403/300
6,195,949 B1 * 3/2001 Schuyler ..... E04C 5/08 411/392
6,327,829 B1 * 12/2001 Taguchi ..... E04B 5/023 403/305
9,410,316 B2 * 8/2016 Reigstad ..... E04B 5/32
9,677,274 B2 * 6/2017 Saiidi ..... E04C 3/34
2004/0182016 A1 * 9/2004 Locke ..... E04B 1/22 52/79.13
2008/0222976 A1 * 9/2008 Liskey ..... E02D 27/12 52/169.9
2008/0236090 A1 * 10/2008 Liberman ..... E04B 1/21 52/741.1
2009/0022545 A1 * 1/2009 Koivunen ..... E02D 5/523 403/379.4
2009/0094915 A1 * 4/2009 Liberman ..... E04B 1/215 52/293.3
2011/0308198 A1 * 12/2011 Comerford ..... E04C 5/165 52/848
2012/0110928 A1 * 5/2012 Liberman ..... E04B 1/34823 52/122.1
2012/0210656 A1 * 8/2012 Martin Hernandez ... E04B 5/32 52/125.1
2014/0123573 A1 * 5/2014 Farnsworth ..... E04B 1/3483 52/79.9
2015/0176278 A1 * 6/2015 Reigstad ..... E04B 5/32 52/223.6
2016/0097199 A1 * 4/2016 Saiidi ..... E04C 3/34 52/126.7
2017/0175376 A1 * 6/2017 Calderon Uriszar-Aldaca ..... E04B 1/215
2017/0247844 A1 * 8/2017 Saiidi ..... E01D 22/00
2017/0356177 A1 12/2017 Lee et al.

OTHER PUBLICATIONS

International Search Report and Written Opinion, dated May 4, 2018, in connection with International Application No. PCT/US2018/018391.

* cited by examiner

SECTION 2-2

SECTION 1-1

METHOD AND APPARATUS FOR CONSTRUCTING A CONCRETE STRUCTURE

CROSS REFERENCE TO RELATED APPLICATIONS

This application claims priority under 35 U.S.C. § 119(c) to U.S. application Ser. No. 62/205,874, filed Aug. 17, 2015, the entire content of which is incorporated into the present application by reference.

FIELD OF THE INVENTION

The present invention relates to a method and apparatus for constructing a concrete structure. In particular, the invention relates to constructing a concrete structure using pre-cast concrete components.

BACKGROUND OF THE INVENTION

Conventional methods and apparatuses for constructing a structure with field poured components can be labor and time intensive. The use of pre-cast elements is desired, but can lead to a weaker structure than can be attained with field poured elements. Accordingly, a need for a more efficient method and apparatus for constructing a strong structure with pre-cast concrete elements has been developed by the present inventors.

SUMMARY OF THE INVENTION

The present invention broadly comprises a method and apparatus for constructing a concrete structure. In one embodiment, a structure includes a column section and a beam section. One of the column section and the beam section includes an assembly with a threaded rod, and the other of the column section and the beam section includes an assembly having an aperture configured to receive the threaded rod.

BRIEF DESCRIPTION OH THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION OF THE PREFERRED EMBODIMENTS

Reference is presently made in detail to exemplary embodiments of the present subject matter, one or more examples of which are illustrated in or represented by the drawings. Each example is provided by way of explanation of the present subject matter, not limitation of the present subject matter. In fact, it will be apparent to those skilled in the art that various modifications and variations can be made in the present subject matter without departing from the scope or spirit of the present subject matter. For instance, features illustrated or described as part of one embodiment can be used with another embodiment to yield a still further embodiment. Thus, it is intended that the present subject matter covers such modifications and variations as come within the scope of the disclosure and equivalents thereof.

Figure 1:
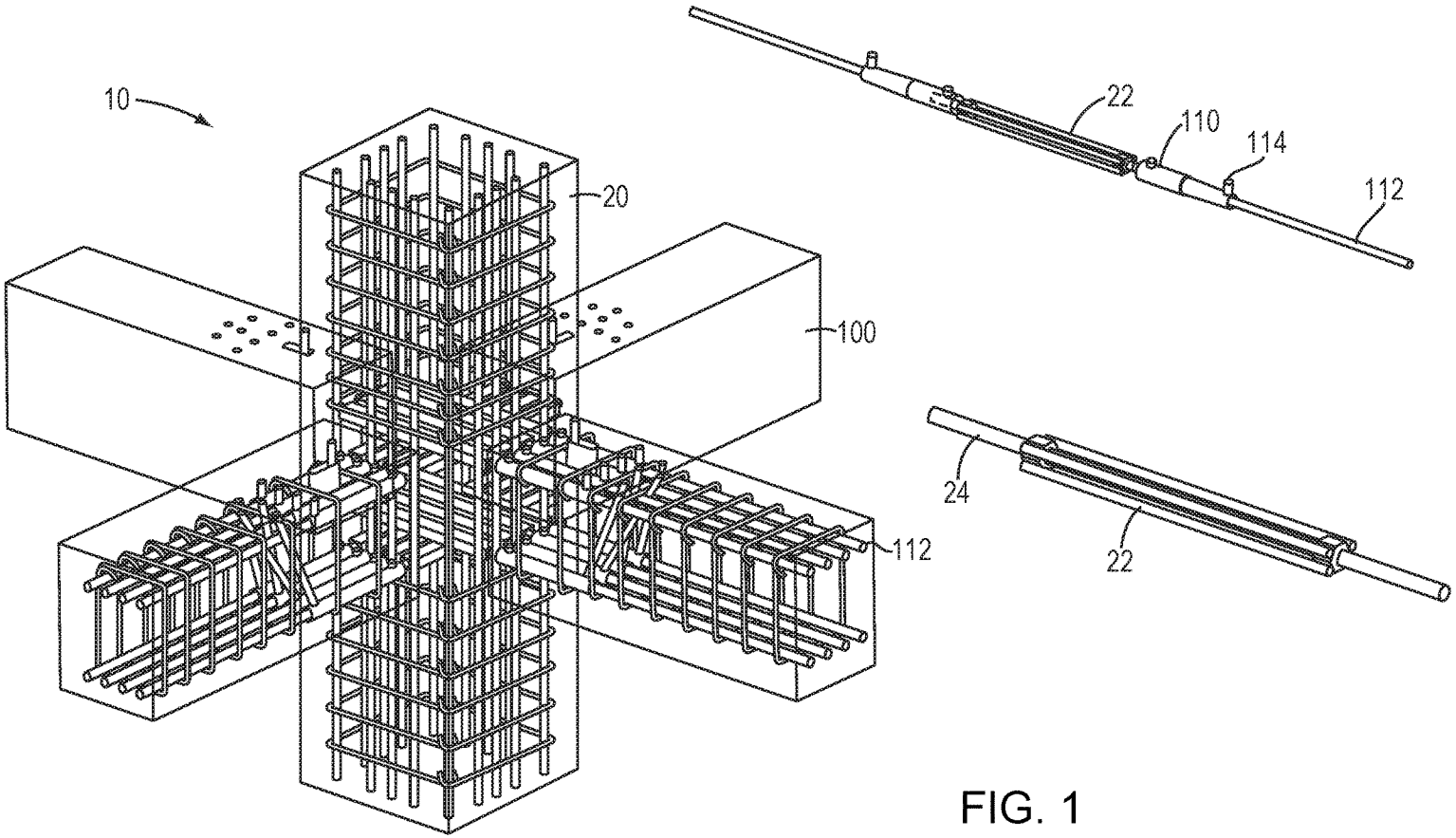
FIG. 1 illustrates an embodiment of a concrete structure that can be constructed according to an exemplary embodiment of the present invention.
Figure 4:
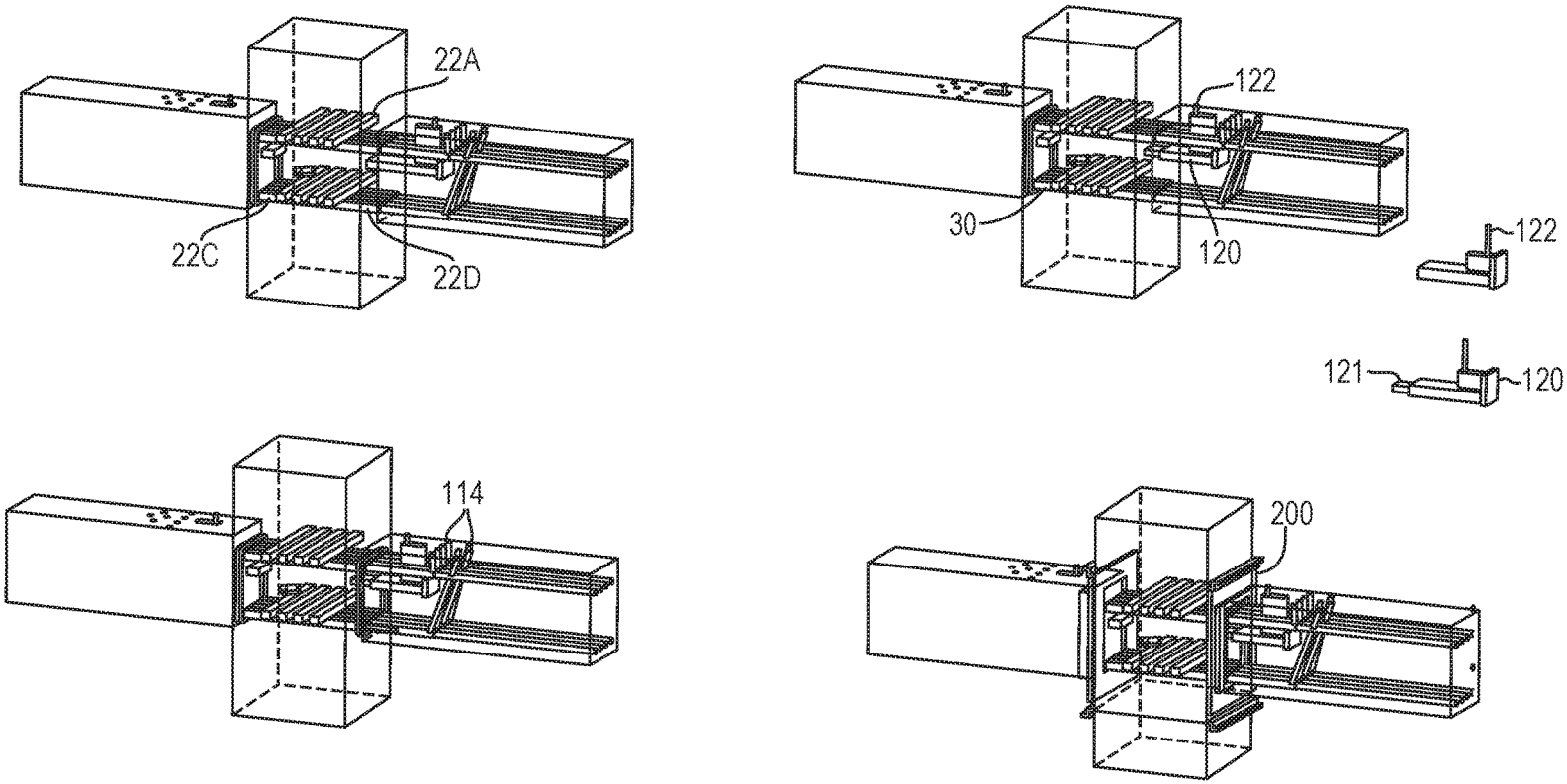
FIGS. 4 and 5A-5E illustrate an exemplary process for making the structure shown in FIG. 1.
Figure 5C:
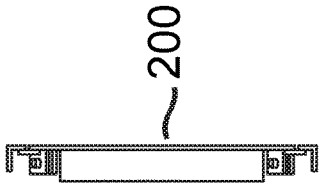
Figure 5B:
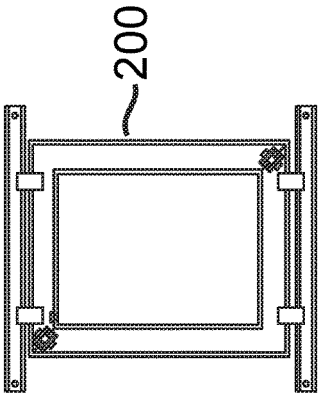
Figure 5D:
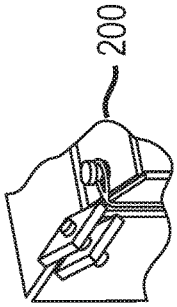
Figure 5E:
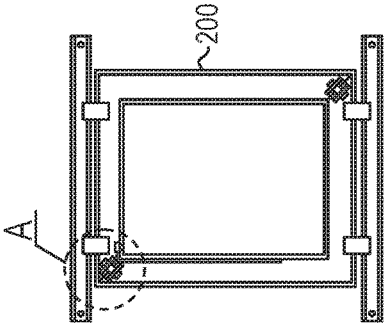
Figure 5A:
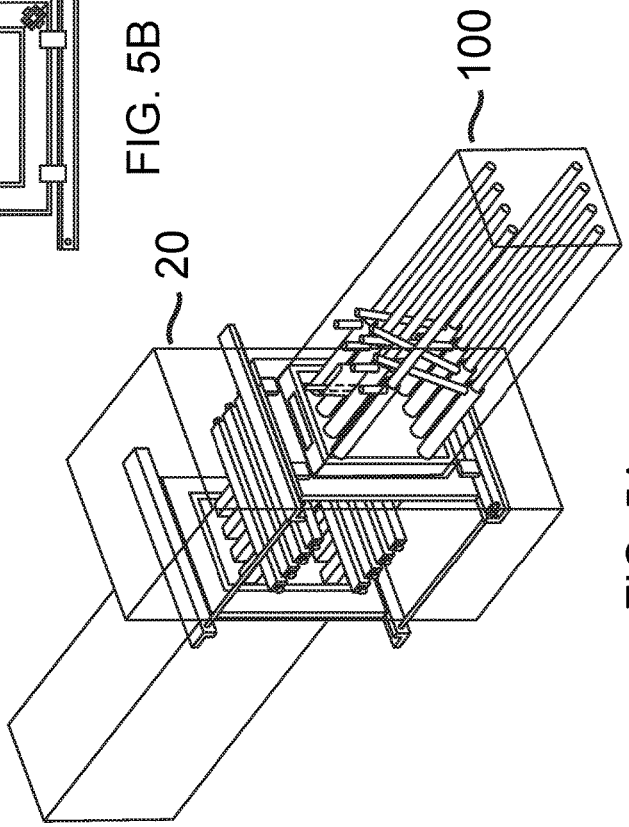

FIG. 1 shows a structure 10 built according to one embodiment of the present invention. Structure 10 includes a column 20 and four beams 100. However, structures with one to three beams 100 connected to column 20 are also possible. Further, any configuration of one to three beams is also included, such a two beams 100 on adjacent sides of column 20 and two beams 100 connected to opposite sides of column 20 (as shown in FIGS. 4 and 5). Such modifications are within the scope of the invention as claimed.

Structure 10 may be used in any type of concrete structure, especially buildings, parking garages, and industrial structures. Columns in the interior of structures may have beams connected to all four sides, while corner columns may have only two beams connected to adjacent sides of a column, and side columns may have only two or three beams attached thereto.

Figure 2:
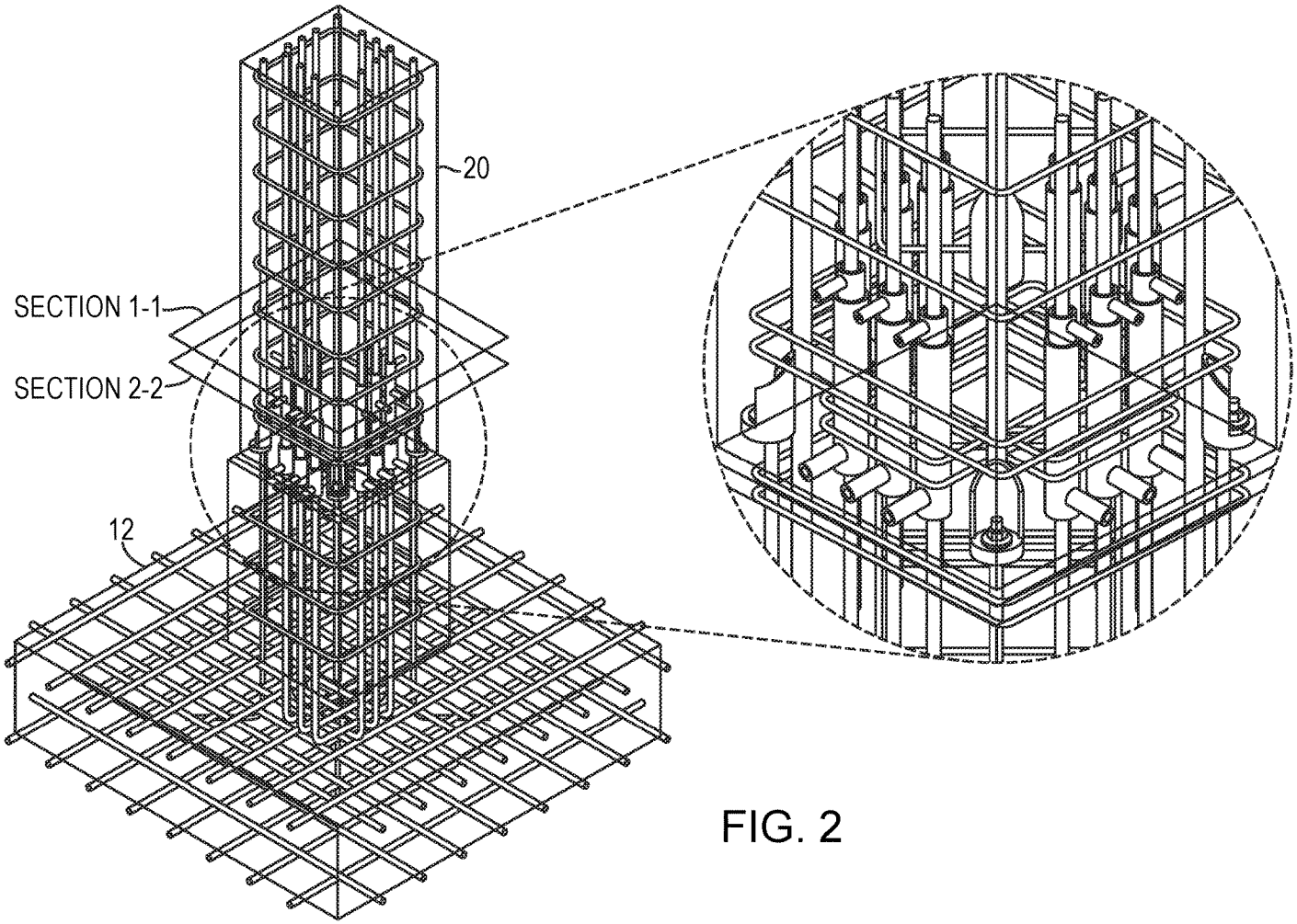
FIG. 2 illustrates an exemplary connection of a column to a foundation.
Figure 3:
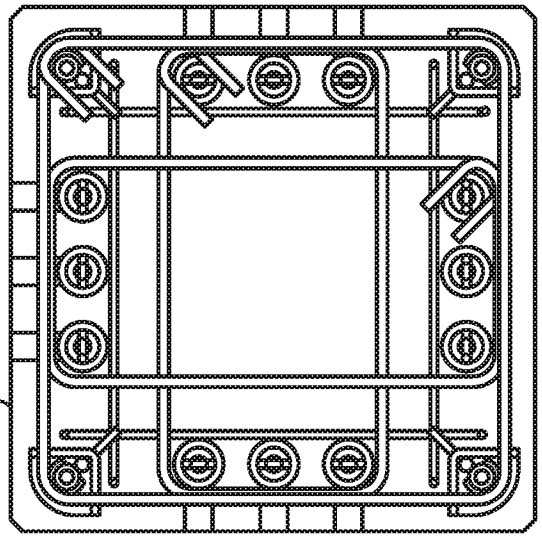
FIG. 3 illustrates cross-sections of the column shown in FIG. 2.
Figure 3:
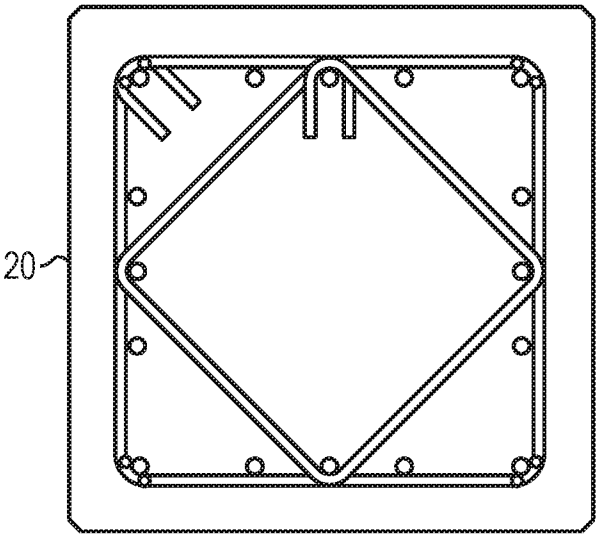

Column 20 may be connected on the bottom end to a foundation 12, as shown in FIGS. 2 and 3. This is an exemplary connection, and other connections to a foundation are also possible. Further, column 20 may be connected to identical columns on the top and bottom to build a tall structure, with only the bottom column 20 connected to a foundation 12.

Column 20 may include an embedded threaded rod assembly 22. In the embodiment shown in FIGS. 1 and 4, column 20 includes 16 such assemblies 22. Four assemblies 22A are arranged in a row at an upper portion of the column 20 and extend between opposite sides, and an additional four assemblies 22B are arranged in a row at an upper portion of the column 20 and extend between the other two opposite sides. Further, four assemblies 22C are arranged in a row at a lower portion of the column 20 and extend between opposite sides, and an additional four assemblies 22D are arranged in a row at a lower portion of the column 20 and extend between the other two opposite sides.

Each assembly 22 includes a threaded rod 24. Threaded rod 24 is initially contained mostly within assembly 22, but is rotated to extend out of assembly 22 and into an aperture in embedded assembly 110 of beam 100 as discussed below.

In this manner, column 20 can connect to 8 beam rebars 112 in each beam 100. These rebars 112 extend the length of the beam 100, ending at embedded assembly 110. Embedded assembly 110 includes an opening at the end of the beam lo receive threaded rod 24. Embedded assembly 110 also includes grout port 114 to receive grout into the assembly 110 after the threaded rod 24 is turned to extend into the assembly 110.

Column 20 also includes aperture 30 which receives shear lug 121 of beam 100. Shear lug 121 can be moved into and out of housing 120 of beam 100 using handle 122. Accordingly, a method of assembling the structure of FIG. 1 is as shown in FIGS. 4 and 5A-5E. First, beam 100 is lifted adjacent column 20 using a crane. Handle 122 is used to move shear lug 121 of beam 100 into aperture 30 of beam 20. The crane can then be disconnected, as shear lug 121 is designed to support beam 100 during assembly. Threaded rods 24 are then rotated until they extend into assemblies 110. Frame 200 is them assembled on the joint between column 20 and beam 100, as shown in FIGS. 4 and 5. Grout is then fed into grout ports 114 to fill the empty volume in assemblies 110 and the space between the column 20 and beam 100. The grout is contained by frame 200 until it dries. Frame 200 is then removed and the connection is complete.

Figure 6:
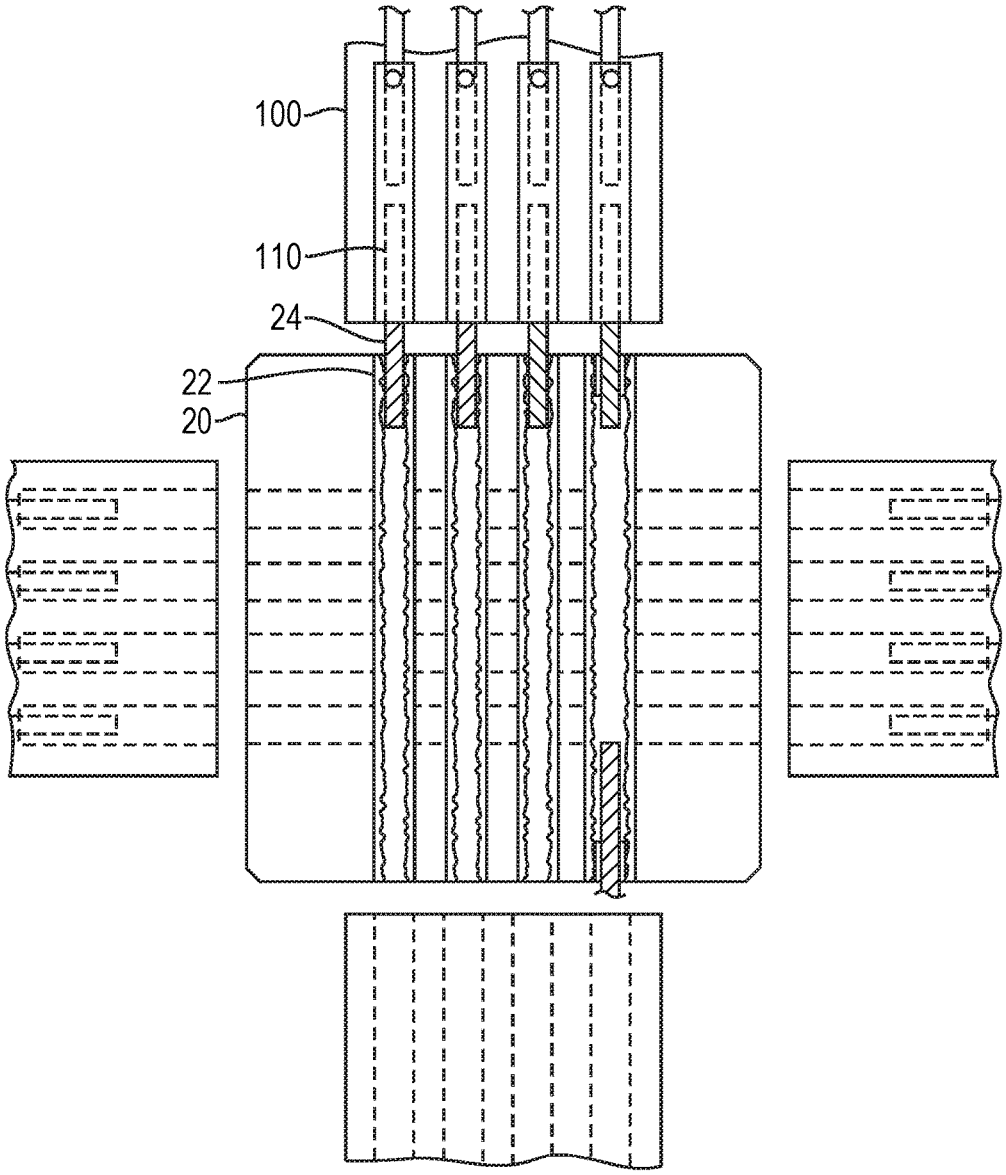
FIG. 6 illustrate a top view of the structure shown in FIG. 1.
Figure 7:
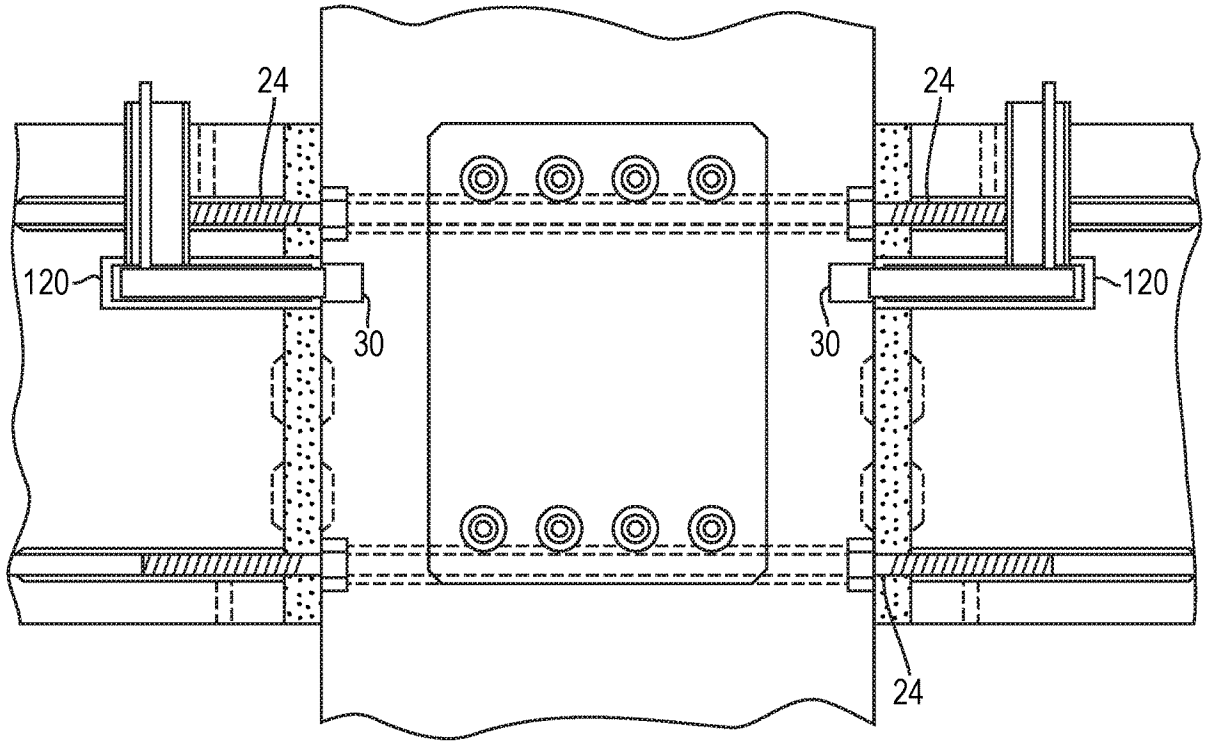
FIG. 7 shows a side view of the structure shown in FIG. 1.
Figure 8:
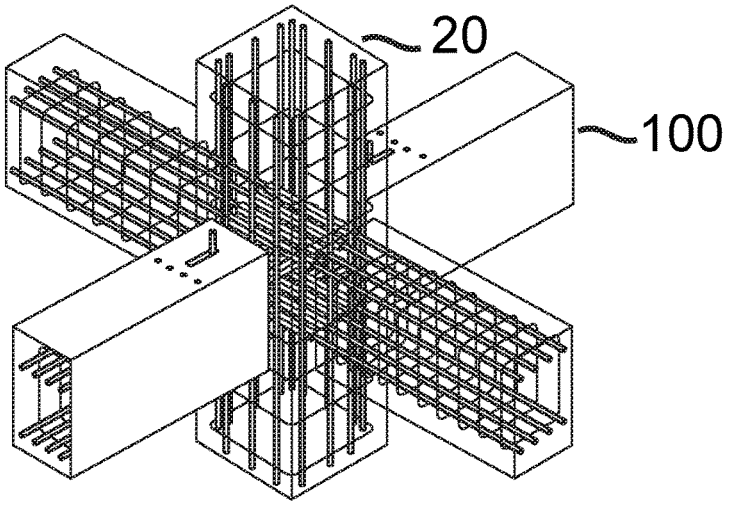
FIG. 8 shows a top perspective view of the structure shown in FIG. 1.
Figure 9:
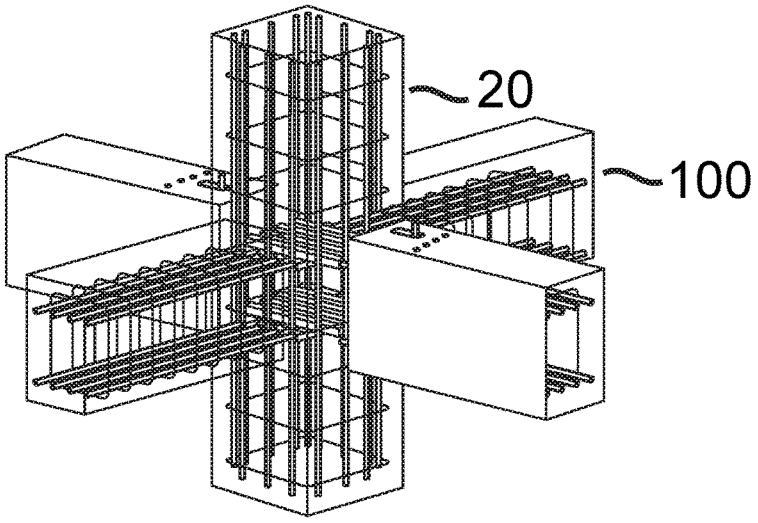
FIG. 9 shows a side perspective view of the structure shown in FIG. 1.
Figure 10:
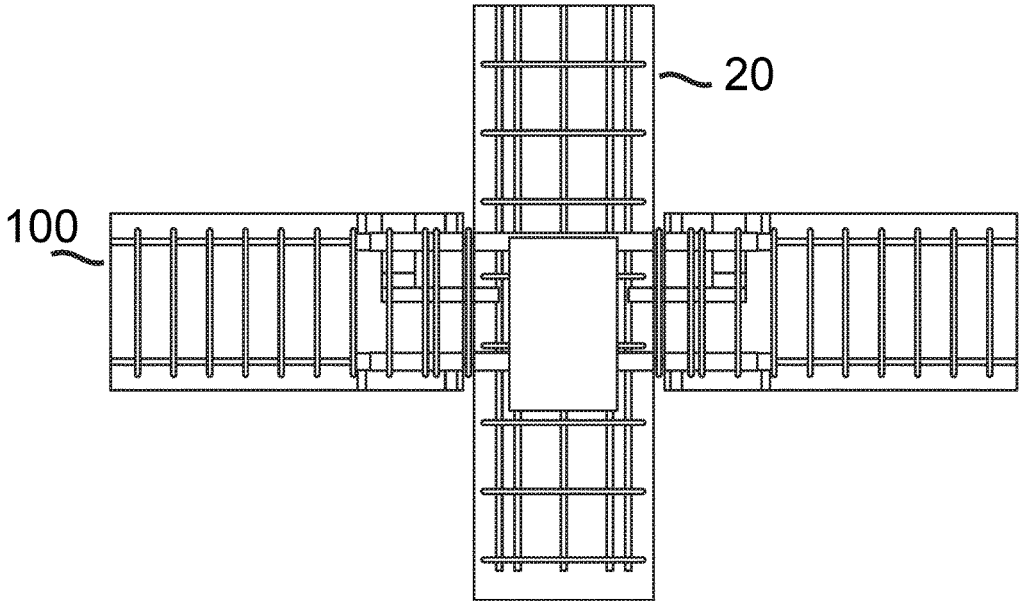
FIG. 10 shows a side internal view of the structure shown in FIG. 1.
Figure 11:
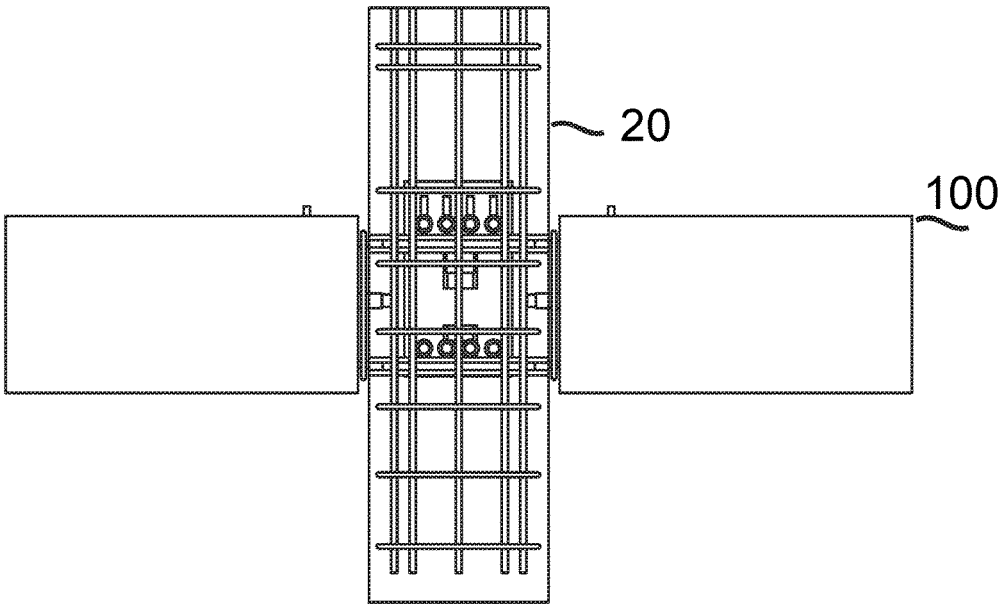
FIG. 11 shows a side external view of the structure shown in FIG. 1.
Figure 12:
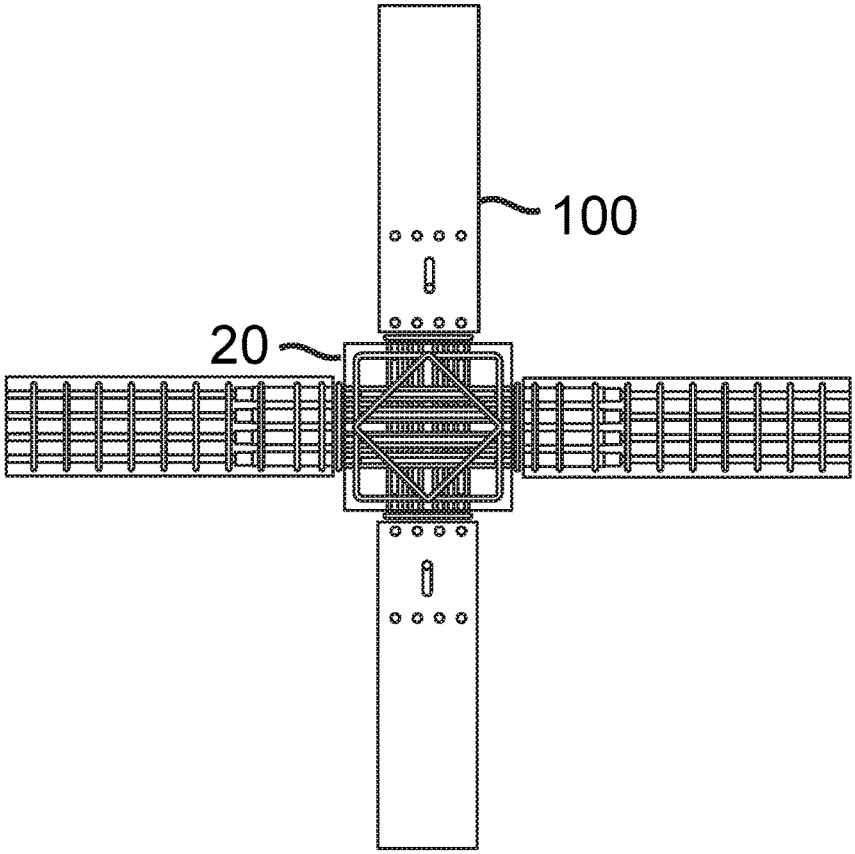
FIG. 12 shows a top internal view of the structure shown in FIG. 1.

FIG. 6 shows a top view of column section 20 with threaded rods 24 extending varying lengths into beam 100. FIG. 7 is a side view of structure 10 showing shear lugs 120 extending into column 20. FIG. 8 is a top perspective view of structure 20 showing the internal details in two of beams 100 and the external details of two of beams 100. FIG. 9 is a side perspective view of structure 10. FIG. 10 is a side view of structure 10 showing the internal details of the column and beams, as shear lug 121 is extended into the column and the threaded rods are extended into the beams. FIG. 11 is a side view of structure 10 showing the internal details of the column section. FIG. 12 is a top view of structure 10 showing the internal details of the column section.

FIGS. 1-12 show that threaded rods 24 are part of column 20 and are extended into beams 100. However, in another embodiment, threaded rods 24 could be part of beams 100 and extended into column 20. These modifications are within the scope of the invention as claimed.

Figure 13:
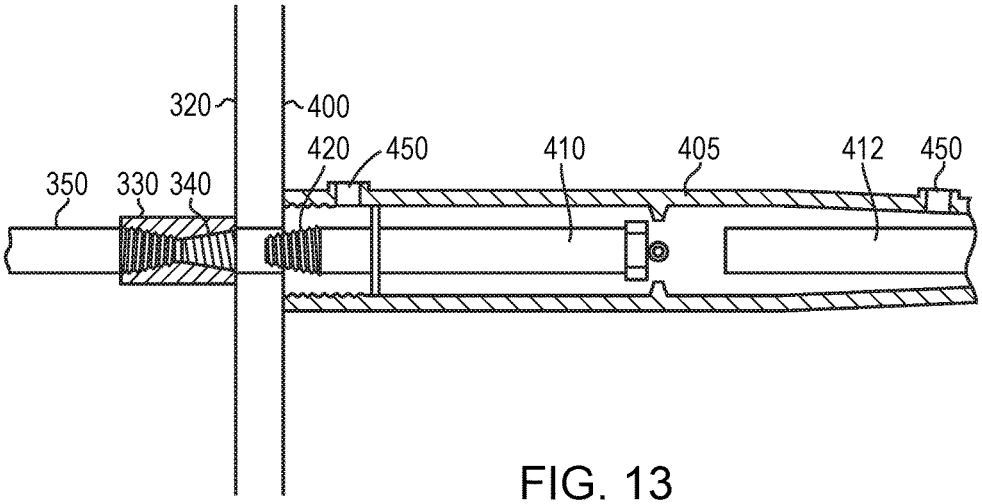
FIG. 13 shows a side view of an alternative embodiment of the structure shown in FIG. 1.
Figure 14:
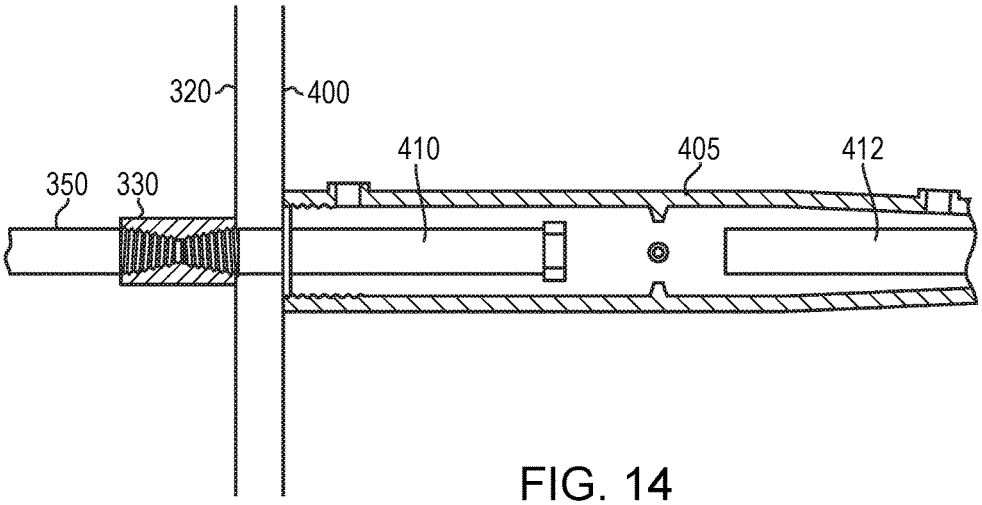
FIG. 14 shows another side view of an alternative embodiment shown in FIG. 13.

In this regard. FIGS. 13 and 14 show an embodiment in which threaded rods 410 are located in beams 400 and during assembly are rotated until they extend into threaded nut 330 in column 320. Rebar 350 may be permanently threaded into an opposite side of nut 330 and extend to another nut 330 on an opposite side of the column 320. Threaded rod 410 may be inside an initially hollow assembly 405. Rebar 412, which extends the length of beam 400, may extend into an end of assembly 405. Apertures 450 in assembly 405 allow an adhesive, such as grout, to be added to the assembly after the rod 410 is threaded into nut 330 to fill all the empty space in assembly 405 and fix the structure permanently.

FIGS. 13 and 14 show that rod 410 and nut 330 have a tapered thread, as opposed to the parallel threads shown in FIGS. 1-12. Either a tapered or parallel thread can be used in any of the embodiments shown in FIGS. 1-14, and these modifications are within the scope of the invention as claimed.

The present written description uses examples to disclose the present subject matter, including the best mode, and also to enable any person skilled in the art to practice the present subject matter, including making and using any devices or systems and performing any incorporated and/or associated methods. While the present subject matter has been described in detail with respect to specific embodiments thereof, it will be appreciated Unit those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

The invention claimed is:

1. A structure comprising:

a pre-cast concrete column section; and a pre-cast concrete beam section, wherein one of the pre-cast concrete column section or the pre-cast concrete beam section includes an embedded first assembly with a threaded rod, and another of the pre-cast concrete column section or the pre-cast concrete beam section includes an embedded second assembly having an aperture configured to receive a first portion of the threaded rod such that the first portion of the threaded rod is held within the aperture only by grout and does not engage any threaded structure within the aperture, and the threaded rod comprises a second portion that is rotatable within the embedded first assembly to extend the first portion of the threaded rod out of the embedded first assembly toward the aperture.

2. The structure according to claim 1, wherein the assembly in the beam section is connected to a rebar in the beam section.

3. The structure according to claim 1, wherein the assembly in the beam section includes a grout port for receiving the grout into a volume around the threaded rod.

4. The structure according to claim 1, wherein the beam includes a shear lug configured to be inserted into an embedded aperture in the column section.

5. The structure according to claim 1, wherein the column section includes eight assemblies with threaded rods and the beam section includes eight corresponding assemblies having apertures configured to receive the threaded rods.

6. The structure according to claim 1, wherein a lower portion of the column section is connected to a foundation.

7. The structure according to claim 1, wherein a lower portion of the column section is connected to another column section.

8. The structure according to claim 1, further comprising:

a second beam section connected to an opposite face of the column section from the beam section.

9. the structure according to claim 1, further comprising:

a second beam section connected to an adjacent face of the column section from the beam section.

10. A method comprising:

providing a pre-cast concrete column section with an embedded first assembly including a threaded rod;

providing a pre-cast concrete beam section including a shear lug;

bringing the pre-cast concrete beam section in close proximity to the pre-cast concrete column section;

extending the shear lug into an embedded aperture in the pre-cast concrete column section;

turning the threaded rod until a first portion of the threaded rod extends into an aperture in an embedded second assembly of the beam section such that the first portion of the threaded rod does not engage any threaded structure within the aperture of the embedded second assembly;

connecting a frame over a joint between the pre-cast concrete column section and the pre-cast concrete beam section;

feeding grout into grout inlets in the embedded second assembly of the pre-cast concrete beam section such that the first portion of the threaded rod is held within the aperture of the embedded second assembly only by the grout; and removing the frame after the grout dries.

* * * * *